US010889767B2

(12) United States Patent
Daguio et al.

(10) Patent No.: US 10,889,767 B2
(45) Date of Patent: Jan. 12, 2021

(54) PERCHLOROETHYLENE DECOMPOSITION REACTOR DESIGN FOR ISOMERIZATION UNIT HYDROGEN FEED, ENABLING A LOWER TEMPERATURE PROCESS WITH INCREASED C5+ YIELD

(71) Applicant: UOP LLC, Des Plaines, IL (US)

(72) Inventors: Jocelyn Daguio, Chicago, IL (US); Ralph C. Norton, Mission Viejo, CA (US); David J. Shecterle, Arlington Heights, IL (US); Patrick J. Bullen, Elmhurst, IL (US); Steven L. Krupa, Fox River Grove, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/412,108

(22) Filed: May 14, 2019

(65) Prior Publication Data

US 2020/0002627 A1 Jan. 2, 2020

Related U.S. Application Data

(60) Provisional application No. 62/691,555, filed on Jun. 28, 2018.

(51) Int. Cl.
*C10G 45/60* (2006.01)
*C10G 45/62* (2006.01)

(52) U.S. Cl.
CPC ..... *C10G 45/60* (2013.01); *C10G 45/62* (2013.01); *C10G 2300/70* (2013.01)

(58) Field of Classification Search
CPC ..... C10G 45/60; C10G 45/62
See application file for complete search history.

(56) References Cited

U.S. PATENT DOCUMENTS

| | | | | |
|---|---|---|---|---|
| 8,753,450 | B2 * | 6/2014 | Norton | C10G 45/60 134/3 |
| 2002/0002319 | A1 * | 1/2002 | Benazzi | C10G 45/62 585/748 |
| 2013/0074870 | A1 * | 3/2013 | Norton | C10G 45/62 134/3 |

* cited by examiner

*Primary Examiner* — Youngsul Jeong

(57) ABSTRACT

An improved isomerization process in which the inlet temperature to the isomerization reaction zone is less than 105° C. is described. A separate reactor is provided for the decomposition of the organic chloride. The product of the decomposition of the organic chloride is sent to an isomerization reactor along with a hydrocarbon feed containing paraffins. The use of the organic chloride decomposition reactor allows the operating temperatures for the isomerization reaction zone to be reduced.

20 Claims, 3 Drawing Sheets

PERCHLOROETHYLENE DECOMPOSITION REACTOR DESIGN FOR ISOMERIZATION UNIT HYDROGEN FEED, ENABLING A LOWER TEMPERATURE PROCESS WITH INCREASED C5+ YIELD

RELATED APPLICATIONS

This application claims the benefit of U.S. Provisional Patent Application Ser. No. 62/691,555 filed on Jun. 28, 2018, the entirety of which is incorporated herein by reference.

FIELD OF THE INVENTION

The invention relates to a process for isomerization of a naphtha feed to produce increased octane isomers for direct blending into the gasoline pool.

BACKGROUND OF THE INVENTION

Isomerization processes are widely used by many refiners to rearrange the molecular structure of straight chain paraffinic hydrocarbons to more highly branched hydrocarbons that generally have higher octane ratings. Many isomerization processes employ a chlorinated catalyst, such as chlorinated alumina catalyst, chlorinated platinum aluminum catalyst, and the like, in a reaction zone (e.g., refers to an area including one or more reactors). The chlorinated catalyst requires a continuous addition of chloride to replace chloride removed from the surface of the catalyst and carried away in the reaction-zone effluent. Typically, a fresh feed of chloride promoter, such as perchloroethylene, is continuously introduced into a paraffin feed stream upstream from a reactor in the reaction zone. Inside the reactor, the chloride promoter decomposes to form hydrogen chloride that activates, e.g., promotes or regenerates, the catalyst by replenishing the chloride removed from the catalyst's surface. The UOP Penex process developed by UOP LLC, Des Plaines, Ill. typically employs two fixed-bed reactors situated in a lead-lag configuration. The reactors contain chlorided platinum-alumina catalyst, which is contacted with a light straight-run (LSR) naphtha feed, hydrogen gas, and a trace organic chloride injection, all of which have been dried to ensure that water (a catalyst poison and corrosion enabler) is not introduced into the process. The organic chloride is converted to hydrogen chloride (HCl), which promotes and maintains the high activity of the catalyst, while the hydrogen serves to aid the product selectivity toward branched isomers by suppressing the polymerization of olefinic intermediates.

Many isomerization units use a chloride source such as perchloroethylene (PERC) to provide the required 150 wppm HCl to the chlorided alumina catalyst to ensure optimal isomerization function. The decomposition temperature of perchloroethylene in the isomerization reactor constrains the isomerization reactor to a higher temperature than is optimal for the isomerization function. Because the minimum decomposition temperature of perchloroethylene to HCl is 105° C., the typical minimum inlet temperature for C4-C6 isomerization reaction zones has been 105° C.

However, it would be desirable to decrease the inlet temperature to the isomerization reaction zone in order to reduce cracking during isomerization.

Therefore, there is a need for an improved isomerization process in which the inlet temperature to the isomerization reaction zone is less than 105° C.

Definitions

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the hydrocarbon molecule. In addition, the term "Cn–Cn+1 hydrocarbon," such as "C5-C6 hydrocarbon," can mean at least one of a C5 and C6 hydrocarbon.

As used herein, the term "zone" can refer to an area including one or more equipment items and/or one or more sub-zones. Equipment items can include one or more reactors or reactor vessels, heaters, separators, exchangers, pipes, pumps, compressors, and controllers. Additionally, an equipment item, such as a reactor, drier or vessel, can further include one or more zones or sub-zones. It should be understood that each zone can include more equipment and/or vessels than depicted in the drawing.

As used herein, the term "fluid transfer device" generally means a device for transporting a fluid. Such devices include pumps typically for liquids, and compressors typically for gases.

As used herein, the term "rich" can mean an amount generally of at least about 50%, and preferably about 70%, by mole, of a compound or class of compounds in a stream.

As used herein, the term "substantially" can mean an amount generally of at least about 90%, preferably about 95%, and optimally about 99%, by mole, of a compound or class of compounds in a stream.

DETAILED DESCRIPTION

Figure 1:
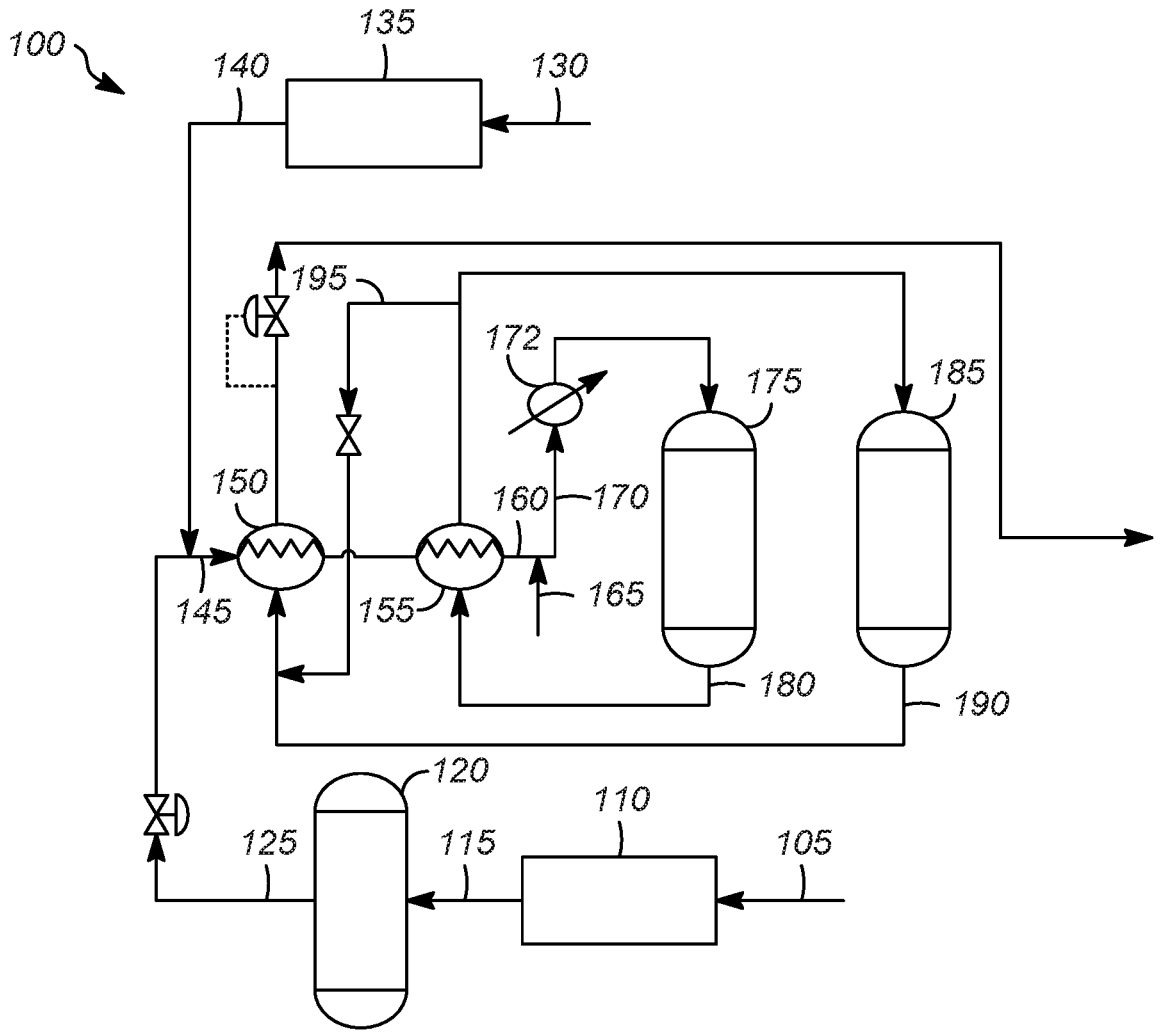
FIG. 1 is an illustration of one embodiment of a prior art isomerization process.

Separation of the organic chloride decomposition function into a separate reactor optimized specifically for organic chloride decomposition allows the isomerization reaction zone to operate a lower temperatures leading to improved yield due to reduced cracking. In addition, the lower operating temperatures allow the use of heavier hydrocarbon feeds, for example, C7+ and higher.

Rather than decomposing the organic chloride into HCl in the isomerization reactor as is done in the prior art, a separate reactor is provided for the decomposition of the organic chloride, such as perchloroethylene. The product of the decomposition of the organic chloride is sent to an isomerization reactor along with a hydrocarbon feed containing paraffins.

The use of the organic chloride decomposition reactor allows the operating temperatures for the isomerization reaction zone to be reduced. For example, typical operating conditions for a typical isomerization process include an isomerization reaction zone inlet temperature of 105° C. Using the process of the present invention, the isomerization reactor zone inlet temperature is less than 100° C., or in the range of 70° C. to 100° C., or 75° C. to 100° C., or 80° C. to 100° C., or 85° C. to 100° C., or 90° C. to 100° C., or 95° C. to 100° C. Typical isomerization conditions include on or more of: a temperature in the range of 80° C. to 215° C.; a pressure in a range of 1.4 MPa(g) to 7.0 MPa(g); or a liquid hourly space velocity in a range of 0.5 to 12 $hr^{-1}$, or 0.5 to 2 $hr^{-1}$.

The stream containing the hydrogen and organic chloride is heated to a temperature of 65° C. to 390° C. before entering the organic chloride decomposition reactor.

The effluent from the organic chloride decomposition reactor may need to be cooled to a temperature in the range of 80° C. to 100° C., for example, before it is combined with the hydrocarbon feed.

The organic chloride decomposition catalyst comprises at least one of: nickel, platinum, or palladium on an inert support. Suitable inert supports include, but are not limited to, alumina.

Suitable hydrocarbon feeds include, but are not limited to, C4 to C8, or C4-C7, or C4-C6, or C5-6, or C4.

One aspect of the invention is a process for isomerizing light hydrocarbons. In one embodiment, the process comprises: heating a dry hydrogen stream and a dry organic chloride containing stream to a temperature of 65° C. to 290° C.; introducing the heated hydrogen stream and the organic chloride containing stream to an organic chloride decomposition reactor containing a chloride decomposition catalyst to decompose the organic chloride to form an effluent stream comprising hydrogen, hydrocarbon, and HCl; and introducing the effluent stream and a light hydrocarbon feed stream, at a temperature of less than 100° C. to an isomerization reaction zone under isomerization conditions in the presence of an isomerization catalyst to form an isomerization effluent.

In some embodiments, introducing the effluent stream and the light hydrocarbon feed stream to the isomerization reaction zone comprises: combining the effluent stream and at least a portion of the light hydrocarbon feed stream before introducing the effluent stream and the light hydrocarbon feed stream to the isomerization reaction zone.

In some embodiments, introducing the heated hydrogen stream and the organic chloride containing stream to the organic chloride decomposition reactor comprises: combining the heated hydrogen stream and the organic chloride containing stream before introducing the heated hydrogen stream and the organic chloride containing stream to the organic chloride decomposition reactor.

In some embodiments, the decomposition catalyst comprises at least one of: nickel, platinum, or palladium on an inert support.

In some embodiments, the process further comprises: combining the hydrogen stream and the organic chloride containing stream before heating.

In some embodiments, the light hydrocarbon feed stream comprises hydrocarbons having 4 to 6 carbon atoms.

In some embodiments, the organic chloride containing stream comprises one or more perchloro $C_2$-$C_3$ hydrocarbons.

In some embodiments, the organic chloride containing stream comprises one or more of perchloroethylene or carbon tetrachloride.

In some embodiments, the effluent stream is introduced into the isomerization reaction zone at the temperature of 70° C. to 100° C.

In some embodiments, the isomerization conditions comprise one or more of: a temperature in a range of 80° C. to 215° C.; a pressure in a range of 1.4 MPa(g) to 7.0 MPa(g)); or a liquid hourly space velocity in a range of 0.5 to 12 $hr^{-1}$.

In some embodiments, the hydrogen to organic chloride molar ratio in the organic chloride decomposition reactor is 350:1 to 2700:1.

In some embodiments, the process further comprises at least one of: sensing at least one parameter of the process and generating a signal from the sensing; sensing at least one parameter of the process and generating data from the sensing; generating and transmitting a signal; or generating and transmitting data.

Another aspect of the invention is a process for isomerizing light hydrocarbons comprising: heating a dry hydrogen stream and a dry organic chloride containing stream to a temperature of 65° C. to 290° C., wherein the organic chloride containing stream comprises one or more of: a perchloro $C_1$-$C_4$ hydrocarbon, or carbon tetrachloride; introducing the heated hydrogen stream and the organic chloride containing stream to an organic chloride decomposition reactor containing a chloride decomposition catalyst to decompose the organic chloride to form an effluent stream comprising hydrogen, hydrocarbon, and HCl; and introducing a combined stream comprising the effluent and a light hydrocarbon stream at a temperature of less than 100° C. to an isomerization reaction zone under isomerization conditions in the presence of an isomerization catalyst to form an isomerization effluent, wherein the light hydrocarbon feed stream comprises hydrocarbons having 4 to 7 carbon atoms.

In some embodiments, wherein introducing the heated hydrogen stream and the organic chloride containing stream to the organic chloride decomposition reactor comprises: combining the heated hydrogen stream and the organic chloride containing stream before introducing the heated hydrogen stream and the organic chloride containing stream to the organic chloride decomposition reactor.

In some embodiments, the process further comprising: combining the effluent and at least a portion of the light hydrocarbon feed stream before introducing the combined stream to the isomerization reaction zone.

In some embodiments, the decomposition catalyst comprises at least one of: nickel, platinum, or palladium on an inert support.

In some embodiments, the process further comprises: combining the hydrogen stream and the organic chloride containing stream before heating.

In some embodiments, the effluent stream is introduced into the isomerization reaction zone at the temperature of 70° C. to 100° C.

In some embodiments, the isomerization conditions comprise one or more of: a temperature in a range of 80° C. to 215° C.; a pressure in a range of 1.4 MPa(g) to 7.0 MPa(g); or a liquid hourly space velocity in a range of 0.5 to 12 $hr^{-1}$.

In some embodiments, the hydrogen to organic chloride molar ratio in the organic chloride decomposition reactor is 350:1 to 2700:1.

In one embodiment, a process for isomerizing a hydrocarbon stream comprises combining a first hydrocarbon feed comprising hydrocarbons and hydrogen and a second hydrocarbon feed comprising C4 to C6 hydrocarbons to produce a combined hydrocarbon feed. A portion of this combined hydrocarbon feed is combined with an organic chloride feed, such as perchlorethylene and then the combined feed is sent to an organic chloride decomposition reactor to decompose the organic chloride. The feed containing the effluent from the organic chloride decomposition reactor is then sent to an isomerization reactor to produce an isomerized hydrocarbon product. The use of a separate reactor to decompose the organic chloride allows the isomerization reactor to be run at a lower temperature than in a conventional system and provides for an increase in yield at these lower temperatures.

Additional features and advantages of the invention will be apparent from the description of the invention, figure and claims provided herein.

Process conditions have been identified for conducting the organic chloride decomposition reaction in the vapor phase where the makeup hydrogen feed to the unit is used to entrain the organic chloride and control the temperature rise from the highly exothermic reaction by $H_2$ dilution. This enables lower temperature isomerization reactor operation and up to a 0.7 wt % C5+ yield increase from the isomerization unit. The organic chloride decomposition reactor minimizes unit cost and allows for a very small reactor and the flexibility to operate over a range of conditions. A lower pressure and/or lower temperature and/or lower excess $H_2$ operating point could be attractive for other applications requiring decomposition of organic chlorides to HCl.

FIG. 1 illustrates one embodiment of an isomerization process 100 using two isomerization reactors. Hydrocarbon feed stream 105 is dried in dryer 110, and the dried hydrocarbon stream 115 is sent to feed surge drum (FSD) 120 and exits as stream 125. Hydrogen stream 130 is dried in dryer 135. Dried hydrogen stream 140 is combined with stream 125 to form combined stream 145 which is sent through heat exchangers 150 and 155 to form a preheated stream 160. An organic chloride stream 165 is added to preheated stream 160 to form stream 170 which contains the hydrocarbon, hydrogen, and organic chloride. Stream 170 is sent to heater 172 and then the first isomerization reactor 175. The first isomerization effluent 180 is sent through heat exchanger 155 to the second isomerization reactor 185. The second isomerization effluent 190 is sent through heat exchanger 150 and recovered. Optionally, a portion 195 of the first isomerization effluent 180 from the first isomerization reactor 175 can be combined with the second isomerization effluent 190 from the second isomerization reactor 185.

Figure 2:
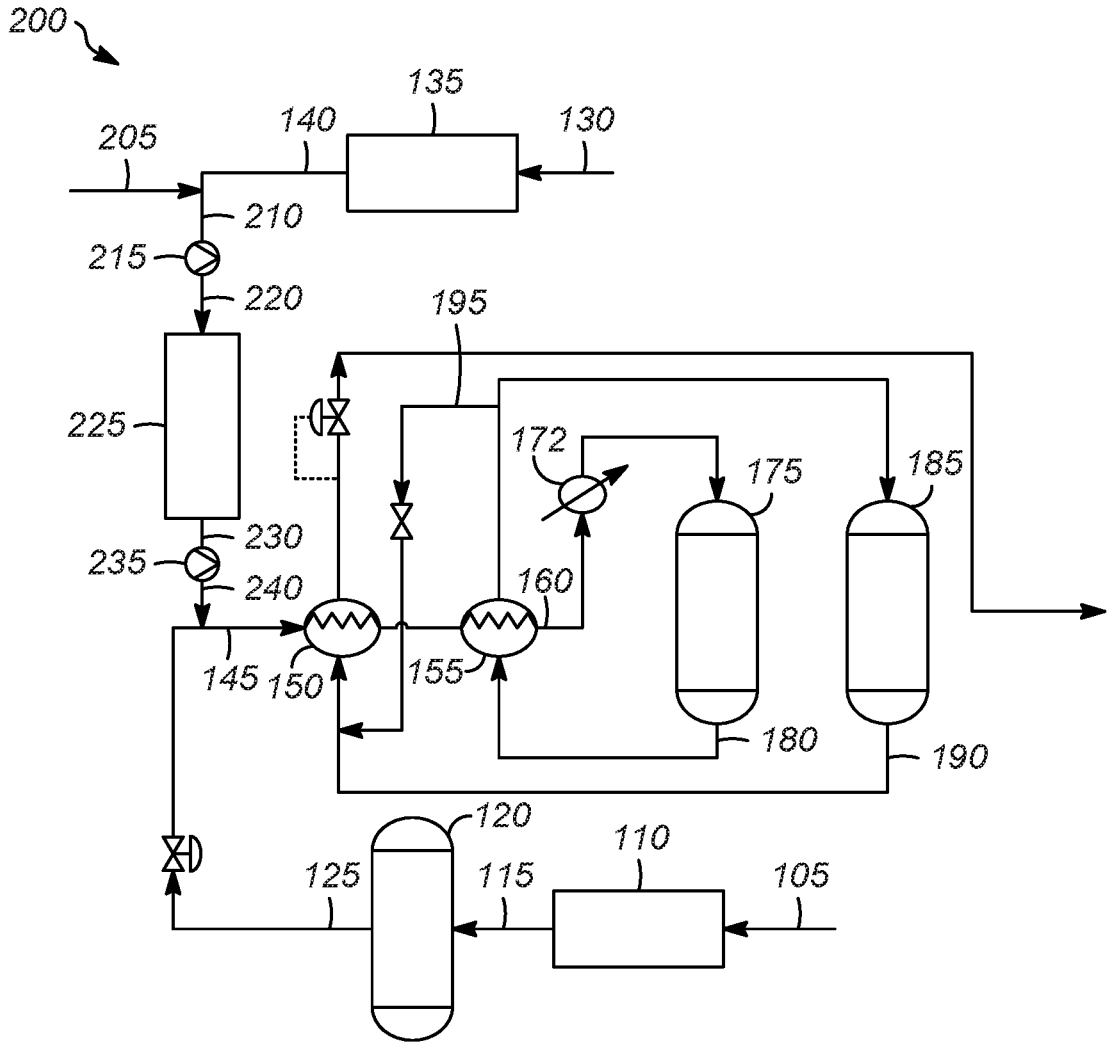
FIG. 2 is an illustration of one embodiment of an isomerization process according to the present invention.

FIG. 2 illustrates one embodiment of the process 200 of the present invention. Hydrocarbon feed stream 105 is dried in dryer 110. The liquid hydrocarbon feed can be rich in a C4 hydrocarbon, such as butane, if the process 200 is a C4 isomerization process. Alternatively, the liquid hydrocarbon feed can be rich in a C5-C6 hydrocarbon, such as pentane-hexane, if the process 200 is a C5-C6 isomerization process. Exemplary apparatuses of both types are disclosed in, e.g., Nelson A. Cusher, UOP Butamer Process and UOP Penex Process of the Handbook of Petroleum Refining Processes, Third Edition, Robert A. Meyers, Editor, 2004, pp. 9.7-9.27. However, the process 200 may also be utilized for simultaneously isomerizing a stream of one or more butanes, one or more pentanes, and one or more hexanes in some exemplary embodiments. Note that the isomerization reactions include those having largely normal paraffins as feedstock and branched paraffins as isomerate product as well as those having largely branched paraffins as feedstock and normal paraffins as isomerate product. In other words, the liquid hydrocarbon stream can be rich in isobutane or branched C5-C6 hydrocarbon. Other isomerization reactions involving the C4 or C5-C6 hydrocarbons are within the scope of the invention as well.

The dried hydrocarbon stream 115 is sent to Feed Surge Drum 120 and exits as stream 125. Hydrogen stream 130 is dried in dryer 135 to form dried hydrogen stream 140.

An organic chloride containing stream 205 is added to the dried hydrogen stream 140 forming stream 210. Stream 210 is sent to heater 215 forming a heated stream 220. The heated stream 220 is sent to the organic chloride decomposition reactor 225 where the organic chloride is decomposed.

The effluent 230 from the organic chloride decomposition reactor 225 contains HCl, hydrocarbons from the organic chloride, hydrogen.

In some embodiments, the effluent 230 is cooled in cooler 235 to form a cooled stream 240.

The cooled stream 240 is combined with the stream 125 to form combined stream 145 which contains hydrocarbons from the hydrocarbon feed stream, HCl, hydrocarbons from the organic chloride, and hydrogen. Combined stream 145 is sent through heat exchangers 150 and 155 to form a preheated stream 160 which is sent to heater 172 and then to the first isomerization reactor 175. The first isomerization effluent 180 is sent through heat exchanger 155 to the second isomerization reactor 185. The second isomerization effluent 190 is sent through heat exchanger 150 and recovered. Optionally, a portion 195 of the first isomerization effluent 180 from the first isomerization reactor 175 can be combined with the second isomerization effluent 190 from the second isomerization reactor 185.

Figure 3:
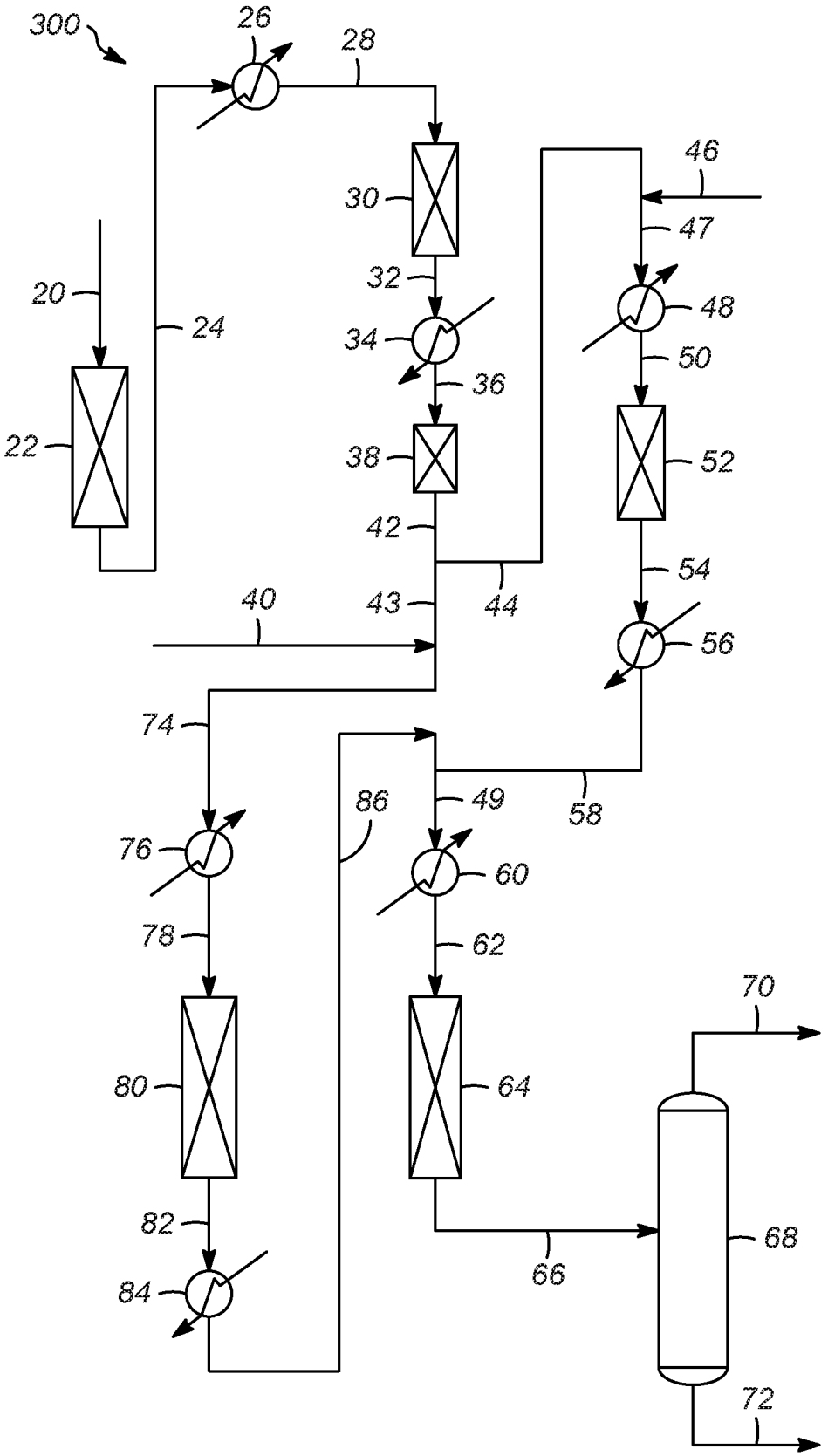
FIG. 3 is an illustration of another embodiment of an isomerization process according to the present invention.

FIG. 3 illustrates another embodiment of the process 300 of the present invention.

As shown in FIG. 3, a gas rich in hydrogen enters in line 20 and is shown passing through sulfur guard bed 22 to line 24 and then heated in heater 26 to line 28. A methanation reactor 30 is shown to generate methane and water from carbon monoxide or carbon dioxide within the fluid to produce a stream in line 32 that is cooled by cooler 34 with the cooled fluid in line 36 dried by drier 38 to continue in line 42. The hydrocarbon rich stream in line 42 is split into streams 43 and 44

Hydrocarbon feed stream 40 is added to line 43 to form a mixed hydrocarbon and hydrogen rich stream in line 74. The fluid in line 74 is heated in heater 76 to form stream 78 which is sent to saturation reactor 80 where olefins and aromatics are saturated. The saturation reactor effluent in stream 82 is cooled in cooler 84 to form stream 86. Stream 86 is mixed with stream 58 to form stream 49. Hydrogen rich stream 44 mixes with stream 46 containing PERC to form stream 47 which is heated in heater 48 to form stream 50. Stream 50 is sent to PERC decomposition reactor 52 to form stream 54 which is cooled in cooler 56 to form cooled stream 58 which mixes with stream 86 to form stream 49. The fluid in line 49 is heated by heater 60 to form heated stream 62 and enters an isomerization reactor 64. While only one isomerization reactor 64 is shown, there are often two reactors used in series, as shown in FIG. 2 for example. Although only an isomerization reactor 64 is depicted, it should be understood that the system can further include other vessels and/or equipment, such as one or more heaters, a recycle gas compressor, a separator vessel, and additional reactors.

The effluent from isomerization reactor 64 can exit in line 66 to a fractionator such as a distillation column 68 that can produce one or more products as shown with a gas 70 such as a fuel gas and an isomerized product in line 72.

The apparatus can include one or more vessels, one or more fluid transfer devices (not shown), one or more drying zones, and one or more downstream vessels. The one or more vessels can include a surge drum 22 or other surge drums as necessary (may be hereinafter referred to collectively as a surge drum) for receiving a hydrocarbon stream and a suction drum (not shown) for receiving a gas rich in hydrogen, such as a recycled hydrogen gas stream.

The optimized organic chloride decomposition reactor minimizes unit cost and allows for a very small reactor and with flexibility to operate over a range of conditions. The different possible isomerization unit flow scheme configurations lead to a range of possible organic chloride concentrations in the decomposition reactor feed when diluted to the maximum extent possible with makeup hydrogen, roughly 0.03-0.25 mol % perchloroethylene or hydrogen/perchloroethylene molar ratio of about 350-2700. Conditions have been identified where near complete decomposition of the organic chloride is achieved using a Pt chloride alumina catalyst at GHSV as high as 60,000 $hr^{-1}$ and in the range of 150-250° C. with high selectivity to the full dechlorination reaction product (ethane). Lower reactor temperatures favor a lower GHSV range of 15,000-30,000/$hr^{-1}$. Because this allows for such a small reactor size, it is envisioned that the commercial reactor may be much larger than technically required, such as in the range of 5000 $hr^{-1}$ GHSV, or as gives a minimum reactor size of one drum of catalyst since catalyst is typically purchased by the drum. Two small reactors of this size could be installed in parallel to allow for easy catalyst replacement without interruption in the delivery of HCl to the downstream isomerization reactor.

It is envisioned that the same catalyst being used in the isomerization reactor would also be used in the perchloroethylene decomposition reactor since this would already available at the customer site and experimental results showed it to be highly effective for perchloroethylene decomposition. Lower Pt content catalyst can be used with adjustment of reactor temperature and/or GHSV to compensate for lower catalyst activity with lower Pt level.

Residual ethylene reaction product (last step in reaction series for perchloroethylene hydrodechlorination) can result in nearly complete hydrogenation by operating at the higher temperature of the range studied, if this is a concern for the downstream process. In the isomerization application, a small residual C2= level is not of consequence since this C2= intermediate has already released 100% of HCl from converted perchloroethylene, and trace C2= will be hydrogenated in the downstream isomerization reactor with no impact on the process. A lower pressure perchloroethylene decomposition reactor was demonstrated with a reduced extent of dechlorination when other process variables are held constant. In the isomerization application, the low pressure PERC decomposition is not considered because the hydrogen stream must be higher pressure to flow into the 550 psig isomerization reactor.

Any of the above conduits, unit devices, scaffolding, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

Specific Embodiments

While the following is described in conjunction with specific embodiments, it will be understood that this description is intended to illustrate and not limit the scope of the preceding description and the appended claims.

A first embodiment of the invention is a process for isomerizing light hydrocarbons comprising heating a dry hydrogen stream and a dry organic chloride containing stream to a temperature of 65° C. to 290° C.; introducing the heated hydrogen stream and the organic chloride containing stream to an organic chloride decomposition reactor containing a chloride decomposition catalyst to decompose the organic chloride to form an effluent stream comprising hydrogen, hydrocarbon, and HCl; introducing the effluent stream and a light hydrocarbon stream at a temperature of less than 100° C. to an isomerization reaction zone under isomerization conditions in the presence of an isomerization catalyst to form an isomerization effluent. An embodiment of the invention is one, any or all of prior embodiments in this paragraph up through the first embodiment in this paragraph wherein introducing the effluent stream and the light hydrocarbon feed stream to the isomerization reaction zone comprises combining the effluent stream and at least a portion of the light hydrocarbon feed stream before introducing the effluent stream and the light hydrocarbon stream to the isomerization reaction zone. An embodiment of the invention is one, any or all of prior embodiments in this paragraph up through the first embodiment in this paragraph wherein comprises combining the heated hydrogen stream and the organic chloride containing stream before introducing the heated hydrogen stream and the organic chloride containing stream to the organic chloride decomposition reactor. An embodiment of the invention is one, any or all of prior embodiments in this paragraph up through the first embodiment in this paragraph wherein the decomposition catalyst comprises at least one of nickel, platinum, or palladium on an inert support. An embodiment of the invention is one, any or all of prior embodiments in this paragraph up through the first embodiment in this paragraph further comprising combining the hydrogen stream and the organic chloride containing stream before heating. An embodiment of the invention is one, any or all of prior embodiments in this paragraph up through the first embodiment in this paragraph wherein the light hydrocarbon feed stream comprises hydrocarbons having 4 to 6 carbon atoms. An embodiment of the invention is one, any or all of prior embodiments in this paragraph up through the first embodiment in this paragraph wherein the organic chloride containing stream comprises one or more perchloro $C_2$-$C_3$ hydrocarbons. An embodiment of the invention is one, any or all of prior embodiments in this paragraph up through the first embodiment in this paragraph wherein the organic chloride containing stream comprises one or more of perchloroethylene or carbon tetrachloride. An embodiment of the invention is one, any or all of prior embodiments in this paragraph up through the first embodiment in this paragraph wherein the effluent stream and the light hydrocarbon stream are introduced into the isomerization reaction zone at the temperature of 70° C. to 100° C. An embodiment of the invention is one, any or all of prior embodiments in this paragraph up through the first embodiment in this paragraph wherein the isomerization conditions comprise one or more of a temperature in a range of 80° C. to 215° C.; a pressure in a range of 1.4 MPa(g) to 7.0 MPa(g)); or a liquid hourly space velocity in a range of 0.5 to 12 $hr^{-1}$. An embodiment of the invention is one, any or all of prior embodiments in this paragraph up through the first embodiment in this paragraph wherein a hydrogen to organic chloride molar ratio in the organic chloride decomposition reactor is 350:1 to 2700:1. An embodiment of the invention is one, any or all of prior embodiments in this paragraph up through the first embodiment in this paragraph, further comprising at least one of sensing at least one parameter of the process and generating a signal from the sensing; sensing at least one parameter of the process and generating data from the sensing; generating and transmitting a signal; or generating and transmitting data.

A second embodiment of the invention is a process for isomerizing light hydrocarbons comprising heating a dry hydrogen stream and a dry organic chloride containing stream to a temperature of 65° C. to 290° C., wherein the organic chloride containing stream comprises one or more of a perchloro $C_1$-$C_4$ hydrocarbon, or carbon tetrachloride; introducing the heated hydrogen stream and the organic chloride containing stream to an organic chloride decomposition reactor containing a chloride decomposition catalyst to decompose the organic chloride to form an effluent stream comprising hydrogen, hydrocarbon, and HCl; and introducing a combined stream comprising the effluent stream and a light hydrocarbon stream at a temperature of less than 100° C. to an isomerization reaction zone under isomerization conditions in the presence of an isomerization catalyst to form an isomerization effluent, wherein the light hydrocarbon feed stream comprises hydrocarbons having 4 to 7 carbon atoms. An embodiment of the invention is one, any or all of prior embodiments in this paragraph up through the second embodiment in this paragraph wherein introducing the heated hydrogen stream and the organic chloride containing stream to the organic chloride decomposition reactor comprises combining the heated hydrogen stream and the organic chloride containing stream before introducing the heated hydrogen stream and the organic chloride containing stream to the organic chloride decomposition reactor. An embodiment of the invention is one, any or all of prior embodiments in this paragraph up through the second embodiment in this paragraph further comprising: combining the effluent and at least a portion of the light hydrocarbon feed stream before introducing the combined stream to the isomerization reaction zone. An embodiment of the invention is one, any or all of prior embodiments in this paragraph up through the second embodiment in this paragraph wherein the decomposition catalyst comprises at least one of nickel, platinum, or palladium on an inert support. An embodiment of the invention is one, any or all of prior embodiments in this paragraph up through the second embodiment in this paragraph further comprising combining the hydrogen stream and the organic chloride containing stream before heating. An embodiment of the invention is one, any or all of prior embodiments in this paragraph up through the second embodiment in this paragraph wherein the effluent stream is introduced into the isomerization reaction zone at the temperature of 70° C. to 100° C. An embodiment of the invention is one, any or all of prior embodiments in this paragraph up through the second embodiment in this paragraph wherein the isomerization conditions comprise one or more of a temperature in a range of 80° C. to 215° C.; or a pressure in a range of 1.4 MPa(g) to 7.0 MPa(g); or a liquid hourly space velocity in a range of 0.5 to 12 $hr^{-1}$. An embodiment of the invention is one, any or all of prior embodiments in this paragraph up through the second embodiment in this paragraph wherein a hydrogen to organic chloride molar ratio in the organic chloride decomposition reactor is 350:1 to 2700:1.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A process for isomerizing light hydrocarbons comprising:

heating a dry hydrogen stream and an organic chloride containing stream to a temperature of 65° C. to 290° C. to form a heated hydrogen stream and a heated organic chloride containing stream;

introducing the heated hydrogen stream and the heated organic chloride containing stream to an organic chloride decomposition reactor containing a chloride decomposition catalyst to decompose the organic chloride to form an effluent stream comprising hydrogen, hydrocarbon, and HCl;

introducing the effluent stream and a light hydrocarbon feed stream comprising hydrocarbons having 4 to 8 carbon atoms at a temperature of less than 100° C. to an isomerization reaction zone; and isomerizing the light hydrocarbon feed stream in the presence of the HCl in the effluent stream under isomerization conditions in the presence of an isomerization catalyst in the isomerization reaction zone to form an isomerization effluent, wherein the HCl maintains the activity of the isomerization catalyst in the isomerization reaction zone.

2. The process of claim 1 wherein introducing the effluent stream and the light hydrocarbon feed stream to the isomerization reaction zone comprises:

combining the effluent stream and at least a portion of the light hydrocarbon feed stream before introducing the effluent stream and the light hydrocarbon feed stream to the isomerization reaction zone.

3. The process of claim 1 wherein introducing the heated hydrogen stream and the heated organic chloride containing stream to the organic chloride decomposition reactor comprises:

combining the heated hydrogen stream and the heated organic chloride containing stream before introducing the heated hydrogen stream and the heated organic chloride containing stream to the organic chloride decomposition reactor.

4. The process of claim 1 wherein the chloride decomposition catalyst comprises at least one of: nickel, platinum, or palladium on an inert support.

5. The process of claim 1 further comprising:

combining the dry hydrogen stream and the organic chloride containing stream before heating.

6. The process of claim 1 wherein the light hydrocarbon feed stream comprises hydrocarbons having 4 to 6 carbon atoms.

7. The process of claim 1 wherein the organic chloride containing stream comprises one or more perchloro $C_2$-$C_3$ hydrocarbons.

8. The process of claim 1 wherein the organic chloride containing stream comprises one or more of perchloroethylene or carbon tetrachloride.

9. The process of claim 1 wherein the effluent stream and the light hydrocarbon stream are introduced into the isomerization reaction zone at a temperature of 70° C. to less than 100° C.

10. The process of claim 1 wherein the isomerization conditions comprise one or more of: a temperature in a range of 80° C. to 215° C.; a pressure in a range of 1.4 MPa(g) to 7.0 MPa(g); or a liquid hourly space velocity in a range of 0.5 to 12 $hr^{-1}$.

11. The process of claim 1 wherein a hydrogen to organic chloride molar ratio in the organic chloride decomposition reactor is 350:1 to 2700:1.

12. The process of claim 1, further comprising at least one of:

sensing at least one parameter of the process and generating a signal from the sensing;

sensing at least one parameter of the process and generating data from the sensing;

generating and transmitting a signal; or generating and transmitting data.

13. A process for isomerizing light hydrocarbons comprising:

heating a dry hydrogen stream and an organic chloride containing stream to a temperature of 65° C. to 290° C. to form a heated hydrogen stream and a heated organic chloride containing stream, wherein the organic chloride containing stream comprises one or more of: a perchloro $C_1$-$C_4$ hydrocarbon, or carbon tetrachloride;

introducing the heated hydrogen stream and the heated organic chloride containing stream to an organic chloride decomposition reactor containing a chloride decomposition catalyst to decompose the organic chloride to form an effluent stream comprising hydrogen, hydrocarbons, and HCl;

introducing a combined stream comprising the effluent and a light hydrocarbon feed stream at a temperature of less than 100° C. to an isomerization reaction zone; and isomerizing the light hydrocarbon feed stream in the presence of the HCl in the effluent stream under isomerization conditions in the presence of an isomerization catalyst in the isomerization reaction zone to form an isomerization effluent, wherein the light hydrocarbon feed stream comprises hydrocarbons having 4 to 7 carbon atoms, and wherein the HCl maintains the activity of the isomerization catalyst in the isomerization reaction zone.

14. The process of claim 13 wherein introducing the heated hydrogen stream and the heated organic chloride containing stream to the organic chloride decomposition reactor comprises:

combining the heated hydrogen stream and the heated organic chloride containing stream before introducing the heated hydrogen stream and the heated organic chloride containing stream to the organic chloride decomposition reactor.

15. The process of claim 13 further comprising:

combining the effluent and at least a portion of the light hydrocarbon feed stream before introducing the combined stream to the isomerization reaction zone.

16. The process of claim 13 wherein the chloride decomposition catalyst comprises at least one of: nickel, platinum, or palladium on an inert support.

17. The process of claim 13 further comprising:

combining the dry hydrogen stream and the organic chloride containing stream before heating.

18. The process of claim 13 wherein the combined effluent and light hydrocarbon stream is introduced into the isomerization reaction zone at a temperature of 70° C. to less than 100° C.

19. The process of claim 13 wherein the isomerization conditions comprise one or more of: a temperature in a range of 80° C. to 215° C.; or a pressure in a range of 1.4 MPa(g) to 7.0 MPa(g); or a liquid hourly space velocity in a range of 0.5 to 12 $hr^{-1}$.

20. The process of claim 13 wherein a hydrogen to organic chloride molar ratio in the organic chloride decomposition reactor is 350:1 to 2700:1.

* * * * *